United States Patent [19]

Pfingston

[11] 4,148,648

[45] Apr. 10, 1979

[54] DIFFUSION TRANSFER ELEMENTS COMPRISING U V LIGHT ABSORBERS

[75] Inventor: William Pfingston, Randolph, Mass.

[73] Assignee: Polaroid Corporation, Cambridge, Mass.

[21] Appl. No.: 768,954

[22] Filed: Feb. 16, 1977

[51] Int. Cl.[2] ..... G03C 1/40; G03C 1/76; G03C 1/48; G03C 1/84

[52] U.S. Cl. ..... 96/73; 96/3; 96/29 D; 96/76 C; 96/77; 96/84 UV

[58] Field of Search ..... 96/84 UV, 3, 29 D, 77, 96/84 R, 73, 76 C

[56] References Cited

U.S. PATENT DOCUMENTS

| | | | |
|---|---|---|---|
| 3,647,437 | 3/1972 | Land | 96/3 |
| 3,698,907 | 10/1972 | Sato et al. | 96/840 V |
| 3,743,531 | 7/1973 | Docharme | 96/77 |
| 3,785,827 | 1/1974 | Piller et al. | 96/84 UV |
| 3,880,658 | 4/1975 | Lestina et al. | 96/77 |
| 3,923,519 | 12/1975 | Cieciuch et al. | 96/77 |

*Primary Examiner*—Richard L. Schilling
*Attorney, Agent, or Firm*—Louis G. Xiarhos; John P. Morley

[57] ABSTRACT

Improved diffusion transfer products having a light-reflecting layer which includes a U V absorber dispersed in the layer.

29 Claims, 2 Drawing Figures

DIFFUSION TRANSFER ELEMENTS COMPRISING U V LIGHT ABSORBERS

BACKGROUND OF THE INVENTION

1. The Field of the Invention

This invention relates to photographic products and processes and particularly to diffusion transfer photographic products and processes.

2. Description of the Prior Art

Diffusion transfer photographic products and processes are known to the art and details relating to them can be found in U.S. Pat. Nos. 2,983,606; 3,415,644; 3,415,645; 3,415,646; 3,473,925; 3,482,972; 3,551,406; 3,573,042; 3,573,043; 3,573,044; 3,576,625; 3,576,626; 3,578,540; 3,569,333; 3,579,333; 3,594,164; 3,594,165; 3,597,200; 3,647,437; 3,672,486; 3,672,890; 3,705,184; 3,752,836; 3,857,865 and British Patent No. 1,330,524 all of which are incorporated here in their entirety.

Essentially, diffusion transfer photographic products and processes involve film units having a photosensitive system including at least one silver halide layer usually integrated with an image-providing material. After photoexposure, the photosensitive system is developed to establish an imagewise distribution of a diffusible image-providing material, at least a portion of which is transferred by diffusion to an image-receiving layer capable of mordanting or otherwise fixing the transferred image-providing material. In some diffusion transfer products, the transfer image is viewed by reflection after separation of the image-receiving element from the photosensitive system. In other products however, such separation is not required and instead, the transfer image in the image-receiving layer is viewed against a reflecting background usually provided by a dispersion of a white, light-reflecting pigment—such as titanium dioxide.

Diffusion transfer photographic processes and products providing a dye image viewable against a reflective background without separation are oftentimes referred to in the art as, "integral negative-positive film units" and such units are of two general types. Integral negative-positive film units of a first type as described for example in the above-referenced U.S. Pat. No. 3,415,644, include appropriate photosensitive layer(s) and image dye-providing materials carried on an opaque support, an image-receiving layer carried on a transparent support and means for distributing a processing composition between them. Photoexposure is made through the transparent base and image-receiving layer and a processing composition which includes a reflecting agent or pigment is then distributed between the image-receiving and photosensitive components. After distribution of the processing composition and before processing is complete, the film unit can be—and usually is—transported into light.

Integral negative-positive film units of a second type, as described for example in referenced U.S. Pat. No. 3,594,165, include a transparent support, carrying the appropriate photosensitive layers and associated image dye-providing materials, a permeable opaque layer, a permeable layer containing a light-reflecting pigment, an image-receiving layer viewable through the transparent support against the light-reflecting layer, and means for distributing a processing composition between the photosensitive layer and a transparent cover or spreader sheet. Additionally, integral negative-positive film units of this second type have means for providing a second opaque layer after photoexposure to prevent additional exposure of the photosensitive element. In film units of this second type, exposure is made through the transparent cover sheet. After distribution of the processing composition and installation of the second opaque layer this type of film unit can also be transported into light before processing is complete.

When integral negative-positive diffusion transfer film units of the types described are exposed to light for extended periods, the color reflection print has sometimes been observed to evidence discoloration of the white areas with time. This discoloration is considered to be caused by a decomposition or chemical change in ingredients of or ingredients associated with the reflecting layer. The decomposition or change is most likely initiated and/or accelerated by the action of light. The problem is most pronounced in those systems employing an opacification system of the type disclosed in U.S. Pat. No. 3,647,437. Such opacification systems include a light-reflecting pigment and an optical filter agent which is rendered colorless after a predetermined period by reduction of the environmental pH.

SUMMARY OF THE INVENTION

Essentially, the present invention presents distinctive reflecting layers having a valuable antistaining or "antiphotolysis" capability for integral negative-positive film units. In accordance with the practice of this invention, a U V absorber(s) is integrated or mixed with the reflecting pigments of such film units to provide photographic products of improved performance characteristics. Accordingly, in film units of the type described in referenced U.S. Pat. Nos. 3,415,644 and 3,647,437, the U V absorber is included in the processing composition containing the reflecting pigment. In the film units of the type described in referenced U.S. Pat. No. 3,594,165 and British Patent No. 1,330,524, the U V absorber(s) is included in the permeable layer containing the light-reflecting pigment.

Particular U V absorbers suitable in the present invention are those substantially colorless, substantially alkali insoluble and non-diffusible U V absorbers which can absorb across the major portions of the region between about 300 to about 400 mμ. A preferred class of U V absorbers employed in the practice of the present invention are certain 2-aryl-4,5-arylo-1,2,3-triazole compounds of the formula:

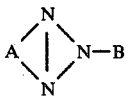

where:

A represents a phenylene radical bound by two neighboring carbon atoms to two nitrogen atoms of the triazole ring, and B represents a phenyl radical, substituted by groups not imparting strong coloration.

Details relating to U V absorbers of the above formula can be found in U.S. Pat. Nos. 3,004,896; 3,189,615; 3,533,794; 3,698,907; and 3,794,493 all of which are incorporated here by reference.

DESCRIPTION OF THE PREFERRED EMBODIMENTS

THE PREFERRED FILM UNITS

The preferred film units of the present invention are integral negative-positive film units of the two types discussed before. Details relating to the first type are found in such patents as U.S. Pat. Nos. 3,415,644, and 3,647,437 while details of the second type are found in such patents as U.S. Pat. No. 3,594,165 and British Patent No. 1,330,524.

Figure 1:
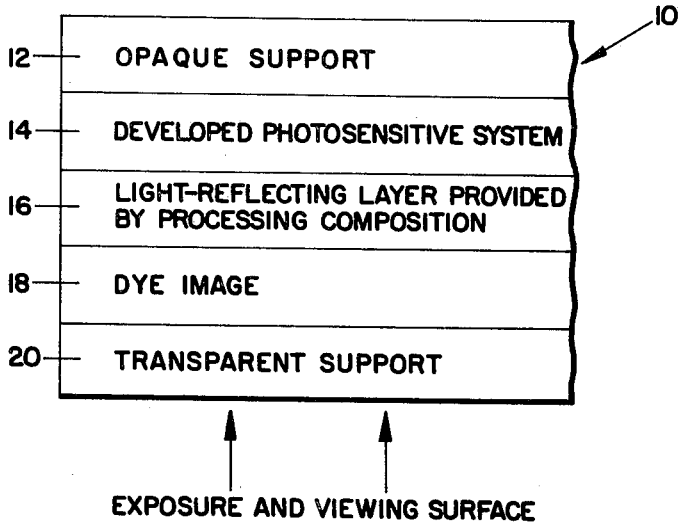
FIG. 1 is a simplified or schematic view of an arrangement of essential elements of one of the preferred film units of the present invention, shown after exposure and processing.

Referring now to FIG. 1 which shows a film unit of the type of referenced U.S. Pat. Nos. 3,415,644 and 3,647,437 following exposure and processing. The film unit 10 includes a light-reflecting layer 16 provided by a light-reflecting pigment in a processing composition initially present in a rupturable container (not shown) and distributed after photoexposure of photosensitive layer(s) 14 through transparent support 20 and image-receiving layer 18. Processing compositions used in film units of the present invention are aqueous alkaline photographic processing composition comprising a U V absorber of the type to be described in more detail later and an opacifying system which include a titanium dioxide pigment as the light-reflecting agent, preferably in combination with an optical filter agent described in detail in U.S. Pat. No. 3,647,437. When the processing composition is distributed over all portions of photoexposed photosensitive system 14, a light-reflecting layer 16 comprising the titanium dioxide and U V absorber is provided between image-receiving layer 18 and photosensitive layer 14. This layer—at least during processing—presents sufficient opacity to protect the photosensitive system of layer 14 from further photoexposure through transparent support 20. As—and after—reflective layer 16 is installed, the processing composition initiates development of photoexposed photosensitive layer(s) 14 in manners well known to the art to establish an imagewise distribution of diffusible image-providing material which can comprise silver or one or more dye image-providing materials. The diffusible image-providing material(s) is transferred through permeable, light-reflecting, titanium dioxide containing layer 16 where it is mordanted, precipitated or otherwise retained in known manner in image-receiving layer 18 where the transfer image is viewed through transparent support 20 against light-reflecting layer 16.

Figure 2:
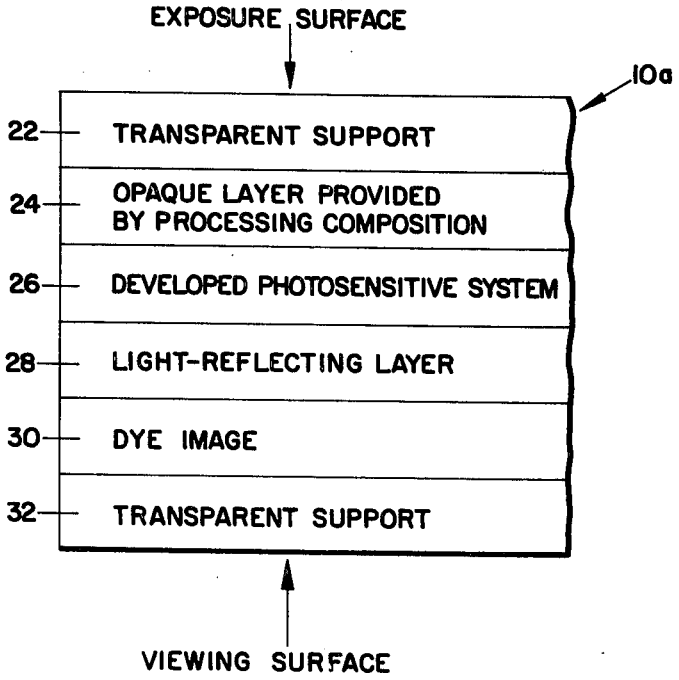
FIG. 2 is a simplified or schematic view of an arrangement of essential elements of an another preferred film unit of the present invention, shown after exposure and processing.

FIG. 2 shows an arrangement of essential elements of a film unit of the types described in referenced U.S. Pat. No. 3,594,165 and British Patent No. 1,330,524 following exposure and processing. The film unit **10*a* includes a processing composition initially retained in a rupturable container (not shown) and distributed between support 22 and photosensitive system or layer 26, after photosensitive element(s) 26 is photoexposed through transparent support 22. Processing compositions used in such film units are aqueous alkaline photographic processing compositions which include an opacifying system comprising an opaque pigment which need not be—and usually is not—light reflecting. After distribution of the precessing composition between transparent support 22 and photoexposed photosensitive layer 26, an opaque layer 24 is installed which protects layer 26 from further photoexposure through support 22. Like the film units of FIG. 1, as and after opaque layer 24 is installed, the processing composition initiates development of photoexposed photosensitive layer 26 to establish an imagewise distribution of diffusible image-providing materials in manners well known to the art. For example, the processing composition alone may cause development or developing agents may be in the film unit so that they may be carried to layer 26 by the processing composition. The diffusible imagewise distribution is transferred through permeable reflecting layer 28 containing the U V absorber to image element 30 where the transfer image is viewed through transparent support 32 against the titanium dioxide, U V absorber containing layer 28. In film units of the referenced patents, an opaque layer 25 containing carbon, for example, is present between layers 26 and 28**.

Suitable photosensitive systems employed in the film units described above are well known to the art and they include those providing silver images as well as color and multicolor images, as set forth in detail in the various patents cross-referenced herein. The most preferred systems are multilayer systems involving a blue-, a green- and a red-sensitive silver halide layer integrated respectively with a yellow, a magneta, and a cyan dye image providing material.

Broadly, the U V absorbers useful in the present invention are those substantially colorless, alkali insoluble and non-diffusible U V absorbers that can absorb across the major portions of the region between about 300 to about 400 mμ. By "substantially colorless" it is meant that the U V absorbers do not add or impart color to the reflecting layers in which they are dispersed. Particularly preferred are those which are colorless or substantially colorless initially and remain so under the processing conditions involved and/or do not undergo any significant discoloration because of the processing conditions. The phrase "alkali insoluble and non-diffusible" means that the U V absorber is insoluble or substantially insoluble and substantially non-diffusible in alkaline processing compositions and will remain in close admixture with the reflecting pigment after formation of the light-reflecting layer. That is to say, the U V absorber will not migrate from the reflecting pigment layer because of its diffusibility or solubility in alkaline processing compositions, although obviously some migration of the U V absorber can occur during processing despite its insolubility and non-diffusibility.

As already mentioned, the preferred class of U V absorbers are 2-aryl-4,5-arylo-1,2,3-triazole compounds of the formula:

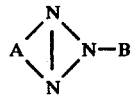

where:

A represents a phenylene radical bounded by two neighboring carbon atoms to two nitrogen atoms of the triazole ring, and, B represents a phenylene radical, substituted by groups not imparting strong coloration.

Particularly preferred U V absorbers of the above are those of the following formula:

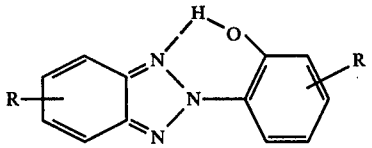

where R is a substituent which does not impart coloration to the U V absorber nor become discolored under the processing conditions involved but also renders the U V absorber substantially insoluble and non-diffusible in alkaline processing compositions or under alkaline processing conditions.

Specific U V absorbers of the above formula particularly useful in the present invention are the following:

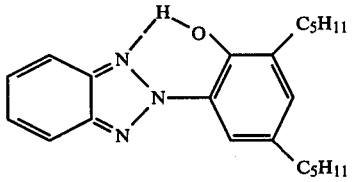

"Tinuvin 328".

and,

-continued

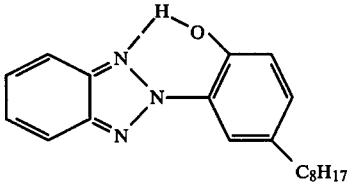

"Cyasorb 5411".

Another class of U V absorbers suitably employed in the practice of the present invention are hydroxy benzophenones conforming to the following formula:

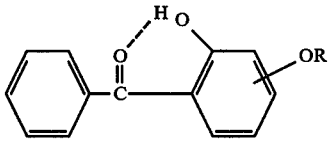

where R is as defined before.

The advantages obtained in accordance with the present invention will be better appreciated by reference to the following examples.

In each of the following examples, the multicolor photosensitive elements of the film units contained the following cyan, magenta, and yellow dye developers.

cyan:

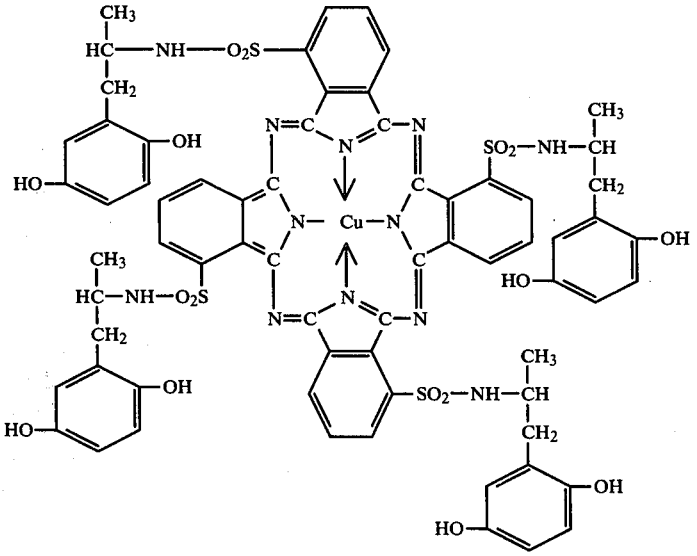

magenta:

-continued

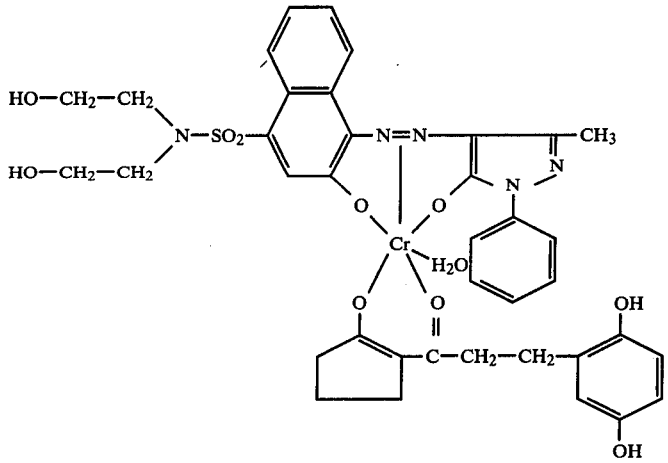

yellow:

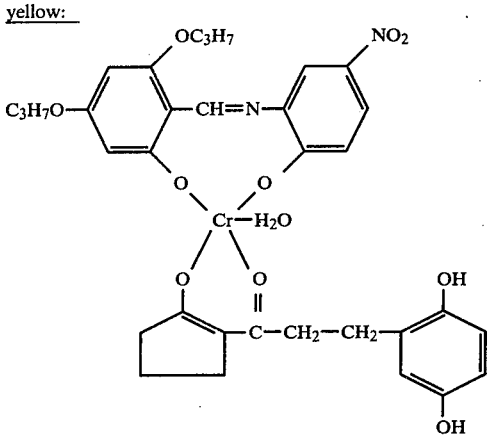

Also, except for variations explained in the Examples, the film units of Examples 1–3 were prepared by coating a gelatin-subcoated 4 mil opaque polyethylene terephthalate film base with the following layers:

1. a layer of cyan dye developer dispersed in gelatin and coated at a converage of about 48 mgs./ft.$^2$ dye and about 98 mgs./ft.$^2$ of gelatin;

2. a red-sensitive gelatino silver iodobromide emulsion coated at a coverage of about 92 mgs./ft.$^2$ of silver and about 125 mgs./ft.$^2$ of gelatin;

3. a layer of a 60-30-4-6 copolymer of butylacrylate, diacetone acrylamide, styrene and methacrylic acid and polyacrylamide coated at a coverage of about 270 mgs./ft.$^2$ of the copolymer and about 8 mgs./ft.$^2$ of polyacrylamide;

4. a layer of magenta dye developer dispersed in gelatin and coated at a coverage of about 62 mgs./ft.$^2$ of dye and about 52 mgs./ft.$^2$ of gelatin;

5. a green-sensitive gelatino silver iodobromide emulsion coated at a coverage of about 70 mgs./ft.$^2$ of silver and about 54 mgs./ft.$^2$ of gelatin;

6. a layer containing the copolymer referred to above in layer 3 and polyacrylamide coated at a coverage of about 107 mgs./ft.$^2$ of copolymer and about 12 mgs./ft.$^2$ of polyacrylamide;

7. a layer of yellow dye developer dispersed in gelatin and coated at a coverage of about 95 mgs./ft.$^2$ of dye and about 56 mgs./ft.$^2$ of gelatin;

8. a blue-sensitive gelatino silver iodobromide emulsion layer including the auxiliary developer 4'-methylphenyl hydroquinone coated at a coverage of about 125 mgs./ft.$^2$ of silver, about 60 mgs./ft.$^2$ of gelatin and about 38 mgs./ft.$^2$ of auxiliary developer; and 9. a layer of gelatin coated at a coverage of about 40 mgs./ft.$^2$ of gelatin.

A transparent 4 mil polyethylene terephthalate film base was coated, in succession, with the following layers to form an image-receiving component:

1. as a polymeric acid layer, a partial butyl ester of ethylene/maleic anhydride copolymer at a coverage of about 2,500 mgs./ft.$^2$;

2. a timing layer containing about a 40:1 ratio of a 60-30-4-6 copolymer of butylacrylate, diacetone acrylamide, styrene and methacrylic acid and polyvinyl alcohol at a coverage of about 500 mgs./ft.$^2$; and 3. a polymeric image-receiving layer containing a 2:1 mixture, by weight, of polyvinyl alcohol and poly-4-vinylpyridine, at a coverage of about 300 mgs./ft.$^2$ A rupturable container retaining an aqueous alkaline processing solution was mounted in a fixed position on the leading edge of each of the image-receiving components, by pressure-sensitive tapes, so that, pressure applied to the container would rupture the container's marginal seal and its contents could be distributed between the image-receiving layer and the gelatin overcoat layer of the superposed photosensitive component.

Except for variations explained in each example, the aqueous alkaline processing composition comprised:

| | |
|---|---|
| Potassium hydroxide (85%) | 4.5 g. |
| N-benzyl-α-picolinium bromide (50% solution in water) | 1.8 g. |
| N-phenethyl-α-picolinium bromide (50% solution in water) | 1.44 g. |
| Sodium carboxymethyl cellulose (Hercules Type 7H4F providing a viscosity of 3,000 cps. at 1% in water at 25° C.) 95% solids | 1.06 g. |
| Titanium dioxide | 41.8 g. |
| 6-methyl uracil | 0.22 g. |
| bis-(β-aminoethyl)-sulfide | 0.035 g. |
| Lithium nitrate | 0.1 g. |
| Benzotriazole | 0.28 g. |
| 6-methyl-5-bromo-4-azabenzimidazole | 0.014 g. |
| Colloidal silica aqueous dispersion (30% $SiO_2$) | 1.82 g. |
| N-2-hydroxyethyl-N,N',N'-tris-carboxymethyl-ethylene diamine | 0.83 g. |
| Lithium hydroxide (57.2% solution in water) | 0.2 g. |
| 6-benzylamino-purine | 0.39 g. |
| Polyethylene glycol (molecular weight 6,000) | 0.53 g. |
| 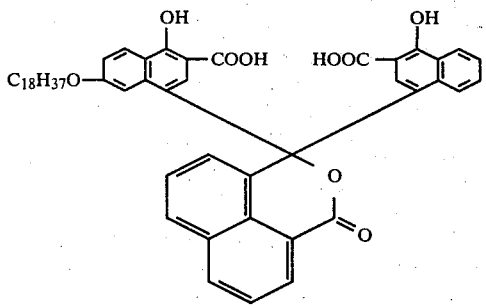 | 2.7 g. |
| 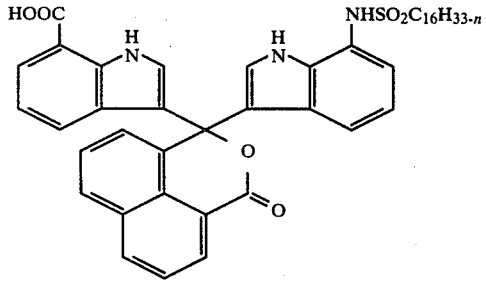 | 0.6 g. |
| water to make 100 g. | |

The photosensitive element was exposed and a layer approximately 0.0028" thick of the processing composition distributed by passing the film unit between a pair of pressure-applying rolls and into a lighted area.

EXAMPLE 1

This example involves a comparison between a film unit prepared as described before which is identified below as the "Control" and a film unit identified below as 077—75. The layers above the photosensitive system of each unit did not have a U V absorber added to them but film unit 077—75 contained "Tinuvin 328" (described before) in the processing composition. The amount of "Tinuvin 328" in the processing composition was sufficient to provide a coverage of "Tinuvin 328" in the distributed reflecting layer of about 200 mgs./ft.$^2$ In order to evaluate the efficiency of "Tinuvin 328" in providing an anti-stain capability, both film units were given a two-meter-candle second white light exposure to fully expose the silver halide layers and thereby prevent any dyes from transferring. The processing compositions of each exposed film unit were then distributed between the image-receiving layer and the gelatin layer as described before. One day later, D-min reflection density measurements were made on each unit and then the units were placed in a Xenon Arc Weatherometer. During the period the film units were exposed to the arc, the intensity of the Xenon Arc varied between about 7000 to about 10,000-foot candles, the temperature in the Weatherometer was about 95–110° F. and the relative humidity was about 75%. D-min measurements were made on each film unit one day later, after which they were replaced in the Xenon Arc Weatherometer and this procedure was continued on successive days. The following data were obtained:

TABLE I

| | D-MIN 24 hrs. after processing | | | D-MIN One day exposure to arc | | | D-MIN Two days exposure to arc | | | D-MIN Three days exposure to arc | | | D-MIN Four days exposure to arc | | | D-MIN Five days exposure to arc | | |
|---|---|---|---|---|---|---|---|---|---|---|---|---|---|---|---|---|---|---|
| FILM UNIT | R | G | B | R | G | B | R | G | B | R | G | B | R | G | B | R | G | B |
| CONTROL | 12 | 18 | 27 | 18 | 32 | 51 | 26 | 47 | 73 | 37 | 61 | 97 | 35 | 59 | 105 | 32 | 57 | 111 |
| 077-75 (Tinuvin 328) | 15 | 20 | 28 | 20 | 33 | 52 | 23 | 41 | 63 | 30 | 50 | 78 | 26 | 44 | 76 | 27 | 45 | 81 |

In evaluating the efficiency of an anti-staining capability, the blue D-min figures are considered the most significant. As can be seen from Table 1, the physical mixing of a U V absorber with the reflective pigment provides an anti-staining capability for film unit 077—75. For example, the amount of staining as measured for blue light is 30 units less for film unit 077—75 after five days as compared to the "Control".

EXAMPLE 2

This example involves a comparison between two film units prepared in the manner described before. However, in this example, the transparent 4 mil polyethylene terephthalate film base of the "Control" had a U V absorber dispersed therein. Also the polymeric acid layer of the "Control" had "Tinuvin 328" dissolved therein in an amount sufficient to provide a coverage of absorber of about 65 mgs./ft.$^2$. The transparent 4 mil polyethylene terephthalate film base of the film unit identified as 37A below had the same amount of the same U V absorber as in the film base of the "Control" but film unit 37A had no "Tinuvin 328" in the acid layer. Instead, the processing composition of film unit 37A included an amount of "Tinuvin 328" sufficient to provide a coverage of the U V absorber in the distributed reflective layer of about 65 mgs./ft.$^2$ In short, this example was designed to determine if there are differences between simply physically mixing the U V absorber with the reflective pigment rather than by dissolving or otherwise intimately dispersing the absorber in a layer positioned above the reflective pigment layer. Exposure, processing and D-min measurement procedures were substantially the same as in Example 1. The following data were obtained:

TABLE 2

| FILM UNIT | D-MIN 24 hrs. after processing | | | D-MIN One day exposure to arc | | | D-MIN Two days exposure to arc | | | D-MIN Three days exposure to arc | | | D-MIN Four days exposure to arc | | | D-MIN Five days exposure to arc | | |
|---|---|---|---|---|---|---|---|---|---|---|---|---|---|---|---|---|---|---|
| | R | G | B | R | G | B | R | G | B | R | G | B | R | G | B | R | G | B |
| CONTROL | 21 | 29 | 31 | 24 | 34 | 37 | 24 | 35 | 38 | 29 | 42 | 50 | 30 | 45 | 57 | 32 | 46 | 59 |
| 37A | 22 | 30 | 32 | 24 | 34 | 35 | 24 | 34 | 37 | 28 | 41 | 49 | 29 | 42 | 53 | 30 | 43 | 53 |

A comparison of the data of Table 2—especially the blue D-min units—reveals that an effective anti-staining capability can be achieved by simply mixing the alkali insoluble U V absorbers with the reflecting pigment rather than by dissolving or otherwise intimately dispersing the U V absorbers in materials to be cast as support layers positioned above the reflecting pigment layers. These physical mixtures of U V absorbers and pigment can be efficiently employed to install reflecting background layers in integral negative-positive film units of both types mentioned before. As shown in this example, the mixtures of pigment and U V absorber can be employed in film units of the type described in U.S. Pat. Nos. 3,415,644 and 3,647,437. In film units of this type, the mixture is employed to install a reflecting background for the unit after photoexposure by simply spreading the mixture within the unit. Likewise, the mixtures of reflecting pigment and alkali insoluble U V absorbers can be employed to provide reflecting layers for film units of the type described in the U.S. Pat. No. 3,594,165 and British Patent No. 1,330,524. In such film units, the reflecting layer is installed in the unit before photoexposure by coating techniques known to the art.

This example illustrates a special advantage of the present invention. It is known from U.S. Pat. No. 3,923,519 to incorporate a U V absorber in the transparent support of an integral negative-positive film unit, and it is known that such use of a U V absorber is effective in reducing U V radiation induced changes resulting in discoloration or staining of the white areas. The effectiveness of such an anti-staining capability is dependent to a large extent on the amount of absorber which can be dissolved or otherwise dispersed in the support. In turn, the amount of absorber which can be effectively dispersed in the support is subject to certain considerations. These considerations include the compatibility and/or the solubility of the absorber in the particular polymeric matrix material of the support as well as the effect of higher amounts of absorber on the optical properties of the support. Accordingly, oftentimes there is a limit to the amount of absorber that can be effectively dispersed in a given support and the efficiency of the anti-staining capability obtained is controlled by such a limitation. If an increased anti-staining capability is required or desired, additional absorber can be dispersed in another layer of the film unit but, the same considerations—solubility, compatibility, etc.—would apply.

By the practice of the present invention however, such considerations can be avoided. Instead, the U V absorber can be simply mixed with the reflecting pigment and an increased anti-staining capability can be provided for the film unit. Accordingly, the present invention contemplates such a combination and thus provides an especially efficient and simple means for increasing or adjusting the anti-staining capability provided for film units employing supports containing U V absorbers and which are positioned above the light-reflecting layers of such units. Reference may be made to the aforementioned U.S. Pat. No. 3,923,519 for details of the incorporation of U V absorbers into support layers, and accordingly, said patent is hereby incorporated herein.

EXAMPLE 3

This example involves a comparison between a film unit having an alkali soluble U V absorber mixed with the reflecting pigment included in the processing composition and a film unit having an alkali insoluble U V absorber—"Tinuvin 328"—mixed with the reflecting pigment of the processing composition. Both of the film units designated as the "087—75" and "088—75" below were prepared substantially in the manner described before. However, the transparent 4 mil thick polyethylene terephthalate film base of each unit had the same amount of the same U V absorber dissolved therein. Film unit "087—75" had "Tinuvin 328" mixed with the reflecting pigment and the amount of "Tinuvin 328" employed was sufficient to provide a coverage of absorber of about 65 mgs./ft.$^2$ on distribution. The amount of U V absorber mixed with the reflecting pigment of film unit "088—75" was substantially the same as that used in film unit "087—75" but instead of "Tinuvin 328", the following alkali soluble U V absorber was used:

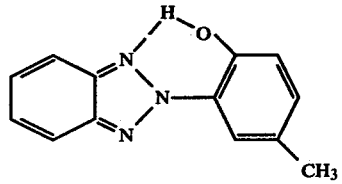

Tinuvin-P

Exposure, processing, and D-min measurement procedures were substantially the same as in Examples 1 and 2. The following data were obtained:

TABLE 3

| FILM UNIT | D-MIN 24 hrs. processing | | | D-MIN One day exposure to arc | | | D Min Two days exposure to arc | | | D-MIN Three days exposure to arc | | | D-MIN Four days exposure to arc | | | D-MIN Five days exposure to arc | | | D-MIN Six days exposure to arc | | | D-MIN Seven days exposure to arc | | |
|---|---|---|---|---|---|---|---|---|---|---|---|---|---|---|---|---|---|---|---|---|---|---|---|---|
| | R | G | B | R | G | B | R | G | B | R | G | B | R | G | B | R | G | B | R | G | B | R | G | B |
| 087-75 | 21 | 28 | 33 | 21 | 30 | 35 | 21 | 31 | 36 | 22 | 31 | 36 | 20 | 30 | 36 | 20 | 30 | 37 | 19 | 31 | 38 | 19 | 30 | 39 |
| 088-75 | 22 | 31 | 35 | 23 | 33 | 38 | 23 | 33 | 39 | 24 | 34 | 40 | 21 | 33 | 40 | 21 | 31 | 41 | 22 | 36 | 46 | 30 | 48 | 62 |

As can be seen from Table 3, a mixture of an alkali soluble or diffusible U V absorber and reflective pigment does not provide—on distribution—a reflecting layer having as effective an anti-staining capability as that obtained with a non-diffusible U V absorber. The failure to achieve the desired degree of effectiveness is considered to be due to the migration or diffusion of the soluble or diffusible U V absorber away from the pigment layer on distribution and/or processing. Accordingly, a critical feature of the reflecting pigment–U V absorber mixtures of the present invention is the insolubility or non-diffusibility of the absorber in the alkaline processing composition so that the absorber is retained in close admixture with the reflecting pigment during formation of the reflecting layer and/or during processing of the film unit. Additional desired features of U V absorbers suitable in the practice of the present invention are that the U V absorbers do not add color to the reflecting layer and be substantially inert under the processing conditions involved.

EXAMPLE 4

The film units of this example were prepared substantially in the manner described before with the 4 mil. polyethylene terephthalate film base of both units containing equivalent amounts of the same U V absorber. However, unlike the "Control", film unit 531 had a U V absorber of the following formula included in the processing composition:

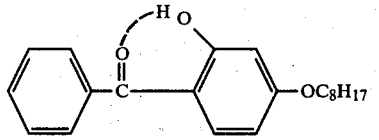

The amount of U V absorber included in the processing composition was sufficient to provide a coverage of about 20 mgms./ft.$^2$ of absorber in the distributed reflective layer. Exposure, processing and D-min measurement procedures were substantially the same as the previous examples. The following data were obtained:

TABLE 4

| | D-MIN 24 hrs. processing | | | D-MIN One day exposure to arc | | | D-MIN Two days exposure to arc | | | D-MIN Three days exposure to arc | | | D-MIN Four days exposure to arc | | | D-MIN Five days exposure to arc | | | D-MIN Six days exposure to arc | | |
|---|---|---|---|---|---|---|---|---|---|---|---|---|---|---|---|---|---|---|---|---|---|
| FILM UNIT | R | G | B | R | G | B | R | G | B | R | G | B | R | G | B | R | G | B | R | G | B |
| Control | 20 | 26 | 28 | 19 | 26 | 26 | 18 | 27 | 27 | 18 | 27 | 28 | 19 | 30 | 33 | 24 | 38 | 46 | 22 | 35 | 42 |
| 531 | 20 | 26 | 29 | 19 | 26 | 26 | 18 | 27 | 27 | 18 | 27 | 27 | 18 | 28 | 30 | 19 | 30 | 35 | 18 | 28 | 29 |

From the above description, it will be apparent that the essence of the present invention resides in the discovery that physical mixtures of the U V absorbers and reflecting pigments can provide reflecting layers having a valuable anti-staining or anti-photolysis capability for integral negative-positive film units. Accordingly, changes and variations may be made in the above examples offered for the purposes of illustrating embodiments of the invention without departing from the spirit and scope of the invention defined in the following claims. For example, the amount of U V absorber employed in the reflecting layer(s) formed before or after exposure can vary depending primarily on the degree of anti-staining capability desired and/or required. Accordingly, a suitable precise amount of U V absorber can be determined empirically but in general, amounts providing a coverage of U V absorber in the reflective layer between about 20 to about 200 mgs./ft.$^2$ are suitable.

What is claimed is:

1. An integral negative-positive film unit which comprises a support carrying a photosensitive system having at least one silver halide emulsion layer associated with a dye image-providing material, a second support which is transparent carrying an image-receiving layer adapted to receive a dye image after photoexposure and processing of the photosensitive system and a light-reflecting layer positioned between the image-receiving layer and photosensitive system or means adapted to provide said light-reflecting layer after photoexposure, said light reflecting layer and said means comprising a light-reflecting pigment and a substantially colorless, substantially alkali insoluble 2-aryl-4,5 arylo-1,2,3-triazole U.V. absorber or a hydroxy benzophenone U V absorber of the structure:

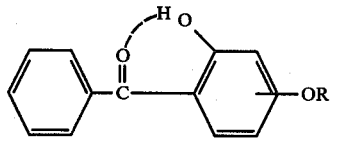

where R represents a substituent which can provide a substantially colorless, substantially alkali insoluble U.V. absorber.

2. A film unit of claim 1 where said light-reflecting pigment is titanium dioxide.

3. A film unit of claim 1 where said U V absorber is a substantially colorless, substantially alkali insoluble 2-aryl-4,5 arylo-1,2,3-triazole U V absorber.

4. A film unit of claim 1 where said U V absorber is a substantially colorless, substantially alkali insoluble hydroxy benzophenone U V absorber.

5. A film unit of claim 1 where said U V absorber is present in said light-reflecting layer in an amount between about 20 to about 200 mgs./ft.$^2$ 6. A film unit of claim 1 where a layer positioned over said light-reflecting layer has a U V absorber uniformly dispersed therein.

7. A film unit of claim 1 where said image-receiving layer is carried by a transparent support which has a U V absorber substantially uniformly dispersed therein.

8. An integral negative-positive film unit which comprises:

a first sheet-like element comprising an opaque support carrying a plurality of layers including at least one photosensitive silver halide layer associated with a diffusion transfer process dye image-providing material;

a second sheet-like element comprising a transparent support carrying a dye image-receiving layer and a rupturable container releasably holding an aqueous alkaline processing composition including a light-reflecting pigment and a substantially colorless, substantially alkali insoluble 2-aryl-4,5 arylo-1,2,3-triazole U V absorber or a hydroxy benzophenone U V absorber of the structure:

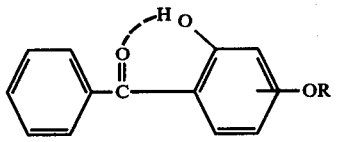

where R represents a substituent which can provide a substantially colorless, substantially alkali insoluble U V absorber.

9. A film unit of claim 8 where said light-reflective pigment is titanium dioxide.

10. A film unit of claim 8 where said U V absorber is a substantially colorless, substantially alkali insoluble 2-aryl-4,5 arylo-1,2,3-triazole U V absorber.

11. A film unit of claim 8 where said U V absorber is a substantially colorless, substantially alkali insoluble hydroxy benzophenone.

12. A film unit of claim 8 where said U V absorber is present in said processing composition in an amount sufficient on distribution to provide a reflecting layer having between about 20 to about 200 mgs./ft.$^2$ of U V absorber.

13. A film unit of claim 8 where said support of said second element or a layer of said element has a U V absorber substantially uniformly dispersed therein.

14. A film unit of claim 8 where said support of said second element has a U V absorber dispersed therein.

15. A film unit of claim 8 where said processing composition includes at least one organic optical filter agent which is colored at a pH above the pKa of the filter agent, the concentration of filter agent being effective to provide a layer exhibiting optical transmission density $> \sim 6.0$ density units with respect to incident light actinic to the silver halide emulsion layer(s) and said film unit comprises means for reducing the pH below the pKa of said optical filter agent after a predetermined period so that said agent is substantially colorless after formation of said dye image in said image-receiving layer.

16. An integral negative-positive film unit which comprises:

a first sheet-like element comprising a first transparent support;

a second sheet-like element comprising a second transparent support carrying, in sequence, a dye image-receiving layer, a light-reflecting pigment containing layer having dispersed therein a substantially colorless substantially alkali insoluble 2aryl-4,5-arylo-1,2,3-triazole U V absorber or a hydroxy benzophenone U V absorber therein of the structure:

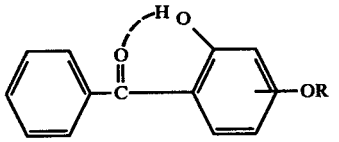

where R represents a substituent which can provide a substantially colorless, substantially alkali insoluble U V absorber and at least one photosensitive silver halide layer associated with a diffusion transfer process dye image-providing material;

a rupturable container releasably holding an aqueous, alkaline, opaque processing composition;

said first and second sheet-like elements being held in superposed, fixed relationship, with said supports outermost, during photoexposure and processing, said photosensitive silver halide emulsion layer(s) being exposable through said first transparent support;

said ruptuable container being positioned transverse one end of said film unit so as to release said processing composition for distribution between said first transparent support and the photosensitive silver halide layers(s).

17. A film unit of claim 16 where said reflecting pigment is titanium dioxide.

18. A film unit of claim 16 where said U V absorber is a substantially colorless, substantially alkali insoluble hydroxy benzophenone U V absorber.

19. A film unit of claim 16 where said U V absorber is present in the light-reflecting layer in an amount between about 20 to about 200 mgs./ft.$^2$

20. A film unit of claim 16 where said second support or a layer between said second support and said light-reflecting layer has a U V absorber uniformly dispersed therein.

21. A film unit of claim 16 where said second support has a U V absorber uniformly dispersed therein.

22. An integral negative-positive film unit comprising in order: a first support; a red-sensitive silver halide emulsion layer; a green-sensitive silver halide emulsion layer; and a blue-sensitive silver halide emulsion layer; said silver halide emulsions associated respectively with a cyan dye developer, a magenta dye developer and a yellow dye developer; an image-receiving layer for receiving image dyes transferred thereto by diffusion as a function of exposure and development of said silver halide emulsion layers; a second support which is transparent and through which said image-receiving layer may be viewed and a rupturable container releasably holding an aqueous alkaline processing composition comprising a reflecting pigment and a substantially colorless, substantially alkali insoluble 2-aryl-4,5 arylo-1,2,3-triazole U V absorber or a hydroxy benzophenone U V absorber of the structure:

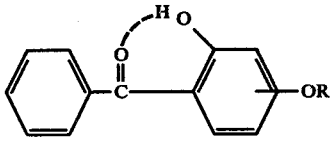

where R represents a substituent which can provide a substantially colorless, substantially alkali insoluble U V absorber, said container being positioned so that distribution of said processing composition is effective to provide a light-reflecting layer between said image-receiving layer and said silver halide emulsion layers.

23. A film unit of claim 22 where said second support carries the following layers in order: a polymeric acid layer, a timing layer and said image-receiving layer and at least one of said layers on said second support has a U V absorber dispersed therein.

24. A film unit of claim 22 where said reflective pigment is titanium dioxide.

25. A film unit of claim 22 where said U V absorber is a substantially colorless, substantially alkali insoluble hydroxy benzophenone U V absorber.

26. A film unit of claim 22 where said U V absorber is present in said processing composition in an amount sufficient on distribution to provide a reflecting layer having between about 20 to about 200 mgs./ft$^2$ of U V absorber.

27. A film unit of claim 22 where said processing composition includes at least one organic optical filter agent which is colored at a pH above the pKa of the filter agent, the concentration of filter agent being effective to provide a layer exhibiting optical transmission density $> \sim 6.0$ density units with respect to incident light actinic to the silver halide emulsion layer and said film unit comprises means for reducing the pH of the unit below the pKa of the optical filter agent after a predetermined period so that said agent is substantially colorless after formation of said color image in said image-receiving layer.

28. An integral negative-positive film unit which comprises:

a first sheet-like element comprising a first transparent support;

a second sheet-like element comprising a second transparent support carrying, in sequence, a dye image-receiving layer, a light-reflecting pigment containing layer having dispersed therein a substantially colorless, substantially alkali insoluble 2-aryl-4,5-arylo-1,2,3-triazole U V absorber, and at least one photosensitive silver halide layer associated with a diffusion transfer process dye image-providing material;

a rupturable container releasably holding an aqueous, alkaline, opaque processing composition;

said first and second sheet-like elements being held in superposed, fixed relationship, with said supports outermost, during photoexposure and processing, said photosensitive silver halide emulsion layer(s) being exposable through said first transparent support;

said rupturable container being positioned transverse one end of said film unit so as to release said processing composition for distribution between said first transparent support and the photosensitive silver halide layer(s).

29. An integral negative-positive film unit comprising in order: a first support; a red-sensitive silver halide emulsion layer; a green-sensitive silver halide emulsion layer; and a blue-sensitive silver halide emulsion layer; said silver halide emulsions associated respectively with a cyan dye developer, a magenta dye developer and a yellow dye developer; an image-receiving layer for receiving image dyes transferred thereto by diffusion as a function of exposure and development of said silver halide emulsion layers; a second support which is transparent and through which said image-receiving layer may be viewed and a rupturable container releasably holding an aqueous alkaline processing composition comprising a light-reflecting pigment and a substantially colorless, substantially alkali insoluble 2-aryl-4,5 arylo-1,2,3-triazole U V absorber, said container being positioned so that distribution of said processing composition is effective to provide a light-reflecting layer between said image-receiving layer and said silver halide emulsion layers.

* * * * *